United States Patent [19]

Chatterson et al.

[11] Patent Number: 4,882,885

[45] Date of Patent: Nov. 28, 1989

[54] PANEL PORT RETENTION SYSTEM

[75] Inventors: Louis M. Chatterson, Kentwood; Bruce Cutean, Holland, both of Mich.

[73] Assignee: Haworth, Inc., Holland, Mich.

[21] Appl. No.: 295,082

[22] Filed: Jan. 6, 1989

[51] Int. Cl.[4] ..... E04B 5/48

[52] U.S. Cl. ..... 52/221; 174/48

[58] Field of Search ..... 52/221; 439/215; 174/48; 220/3.5, 3.6

[56] References Cited

U.S. PATENT DOCUMENTS

| | | | |
|---|---|---|---|
| 3,377,756 | 4/1968 | Polhamus | 174/48 X |
| 3,683,100 | 8/1972 | Deal et al. | 174/48 |
| 4,060,294 | 11/1977 | Howorth et al. | 439/215 |
| 4,232,183 | 11/1980 | Person | 52/221 X |
| 4,367,370 | 1/1983 | Wilson et al. | 439/215 X |
| 4,493,174 | 1/1985 | Arens | 52/221 X |
| 4,504,698 | 3/1985 | Greenwood | 174/48 X |
| 4,685,255 | 8/1987 | Kelley | 52/221 X |
| 4,778,399 | 10/1988 | Schenk | 174/48 X |
| 4,781,609 | 11/1988 | Wilson et al. | 439/215 |

*Primary Examiner*—Carl D. Friedman

*Attorney, Agent, or Firm*—Flynn, Thiel, Boutell & Tanis

[57] ABSTRACT

A space-dividing panel having an interior rectagular framework provided with coverings on both sides thereof, and channels extending along either or both of the upper and lower edges thereof for accommodating communication and elctrical cables. A porting arrangement is secured to and within the panel to provide porting for electrical or communication cabling substantially at worksurface height.

6 Claims, 5 Drawing Sheets

PANEL PORT RETENTION SYSTEM

FIELD OF THE INVENTION

This invention relates to an upright space-dividing wall panel of the type used in offices and the like and, more particularly, to an improved port retention system which can be provided in the side of the panel substantially at worksurface height to provide convenient access for electrical or communication connectors.

BACKGROUND OF THE INVENTION

Interior space-dividing wall panels are extensively utilized in offices and the like to divide large areas into smaller working areas. Such panels conventionally have an interior rectangular framework provided with either hard or soft coverings on opposite sides thereof, with the panel conventionally having trim rails releasably attached to the opposite vertical edges and a top cap releasably attached to the upper edge. A channel structure is also conventionally provided along the lower edge for accommodating electrical cabling.

These known wall panels are conventionally provided with desk-like worksurfaces attached to one or both sides thereof, and thus accessing electrical and/or communication cabling from the worksurface has been of great importance. Often times such cabling has been extended upwardly from the bottom channel outside the panel and fed to equipment located on the worksurface. Other times the cabling has been fed along the vertical edge of the panel. For example, the electrical cables are often fed upwardly from the lower channel. Some panels have also provided a top channel for communication cables, and such cables have been fed downwardly along the vertical edge of the panel for access to the worksurface.

As still an alternate solution, some panel manufacturers have provided a channel extending horizontally across the panel substantially at worksurface height, and such channel has been provided with electrical and/or communication cables extending longitudinally therethrough from panel to panel, and at the same time provide access to such electrical and/or communication cables from the worksurface. This latter solution, however, normally results in the side surfaces of the panel, such as the fabric coverings, being dividing longitudinally at worksurface height by plastic covers which extend the full width of the panel. Such an arrangement can have an undesirable effect on the overall appearance of the panel. This type structure can also have an impact on the strength and construction of the panel.

Accordingly, the present invention relates to a conventional space-dividing panel having an interior rectangular framework provided with coverings on both sides thereof, which panel is also conventionally provided with channels extending along either or both of the upper and lower edges thereof for accommodating communication and electrical cables which extend through the panel system. In this improved panel, however, there is provided a porting arrangement which can be readily secured to and within the panel, either at the factory or by being retrofitted in the field, so as to provide porting for electrical or communication cabling substantially at worksurface height. At the same time, this improved panel porting arrangement can be formed directly into the panel side surface without requiring covers or other similar structures extending longitudinally across the panel width, and can be installed close to but spaced inwardly a small distance from one side edge of the panel, whereby the resulting overall appearance of the panel is not significantly affected.

In this improved panel porting arrangement, a small generally rectangular opening is formed in the side covering (such as the fabric and the underlying fiberglass layer) adjacent to but spaced slightly inwardly from one end edge of the panel, the opening being substantially at worksurface height. A similar aligned opening is formed in the underlying sheet-like skin which is secured to the side of the rectangular framework. A two-piece rectangular frame, having a width substantially corresponding to that of the panel core, is positioned between the sheet-like skins which are attached to opposite sides of the rectangular framework. A rectangular fabric securement frame is disposed over the outside of the skin in surrounding relationship to the opening. This fabric securement frame has fabric engaging teeth along the inner edge thereof. Fasteners such as screws or the like extend through the fabric securement frame, the skin and the two-piece frame. An electrical receptacle unit (i.e. an electrical port) can be positioned within the frame and an electrical cable attached therethrough by being extended vertically through the adjacent rail of the framework and then being fed sidewardly into the frame. The region within the opening located above the frame can be provided for communication ports, such as for computers, telephones or the like. The covering fabric of the panel is wrapped around the toothed inner edge of the fabric retaining frame and secured tautly in position by retainer strips which attach to the edges of the fabric retaining frame. An outer covering plate is snappingly retained within the opening and has edges which overlap the adjacent edges of the fabric to provide a finished appearance. The covering plate has suitable openings therein for the electrical receptacle and for the communication ports.

Other objects, purposes and advantages of the invention will be apparent to persons familiar with structures of this general type upon reading the following specification and inspecting the accompanying drawings.

Figure 1:
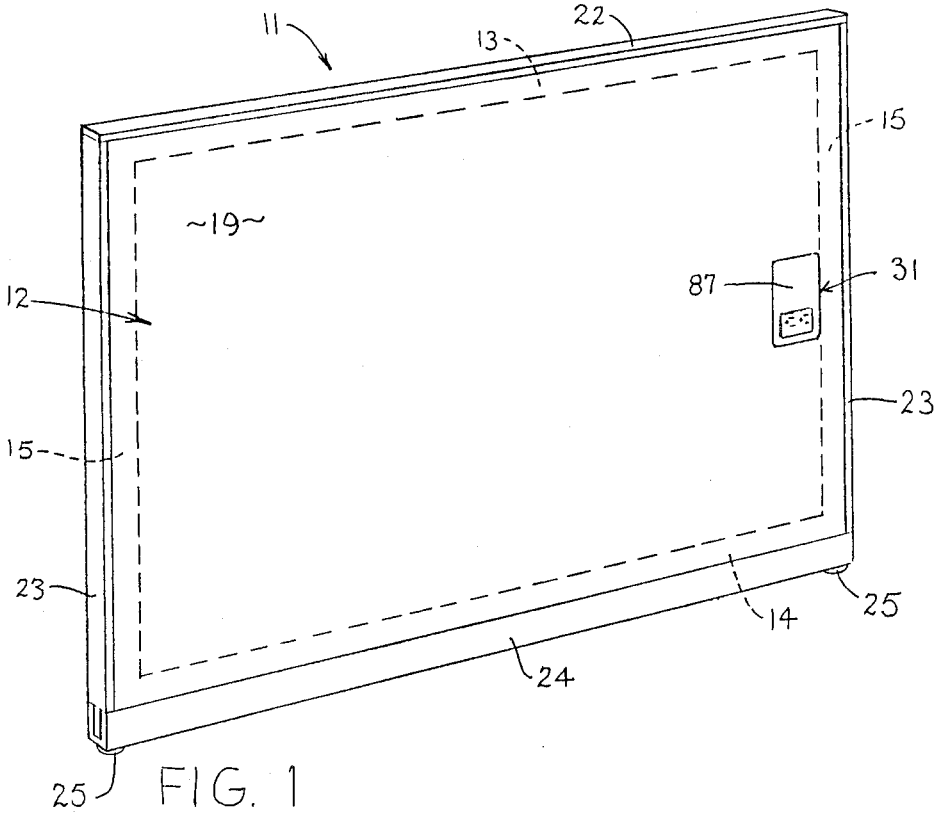
FIG. 1 is a perspective view of a conventional upright wall panel having the improved worksurface-height port retention arrangement of this invention associated therewith.

Certain terminology will be used in the following description for convenience in reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the panel and of parts and components associated therewith. Said terminology will include the words specifically mentioned, derivatives thereof, and words of similar import.

DETAILED DESCRIPTION

FIG. 1 illustrates therein a generally conventional panel assembly 11 which includes a generally rectangular panel 12 having an internal rectangular framework which, as indicated by dotted lines, includes generally parallel top and bottom frame rails 13 and 14 respectively and rigidly joined together by side frame rails 15. This internal rectangular framework has thin sheet-like side skins 16 (FIG. 3), such as of metal, fixedly secured to opposite sides thereof and extending throughout substantially the full extent of the panel. These side skins 16, in the illustrated embodiment, confine therebetween a paper honeycomb core structure 17 which occupies the interior of the rectangular framework. Acoustical flexible layers, such as fiberglass layers 18, exteriorly overlie the skins 16, and themselves are covered by flexible fabric coverings 19 which define the exterior side surfaces of the panel. These fabric coverings 19 are secured along their outer edges by suitable retainers 21 (FIG. 5) which resiliently clip to the rails defining the framework.

The panel assembly 11 conventionally includes a removable top rail 22, and removable side trim rails 23, the latter often being provided with vertically extending rows of slots for accommodating hanging brackets associated with components which mount on the panel. A bottom channel 24 extends along the lower edge of the panel and may confine therein the components which define the electrical system for the panel, which electrical system joins from panel-to-panel as said panels are horizontally serially connected. The panel assembly also is conventionally provided with leveling guides or feet 25 adjacent the opposite lower corners thereof.

The overall arrangement of the panel, as briefly described above, is conventional. Reference is made to U.S. Pat. Nos. 4 060 294, 4 084 366, 4 666 223 and 4 781 609.

The improved panel of the present invention is provided with a port retention arrangement 31 accessible from one or both sides thereof, which port retention arrangement is preferably disposed in the vicinity of but slightly inwardly from one of the side edges, and is at an elevation which approximately corresponds to worksurface height. In this regard, worksurface height is normally in the range of from about 26 to about 30 inches above the floor. Hence, this port retention arrangement 31 is provided at an elevation which is substantially above the lower edge of the panel, but substantially below the upper edge of the panel, and is thus in the vicinity of worksurface height to provide convenient access to electrical power and/or communication ports for equipment located on a desk-like worksurface disposed closely adjacent the side of the panel.

To accommodate and permit the port retention arrangement 31 to be provided on the panel assembly, the latter is provided with a vertically-elongate rectangular opening 32 formed in at least one of the side skins 16. This opening 32 is positioned closely adjacent but slightly horizontally spaced inwardly from the free end edge of the panel, and disposed so that its lower edge closely approximates worksurface height. Such opening 32 is hence spaced inwardly from the free vertical edge of the skin. While the opening 32 need be provided only in one side skin 16, nevertheless aligned openings can be provided through both side skins 16 if desired to permit porting to be accessible from both sides of the panel. The embodiment as described herein, and as illustrated in the drawings, does have aligned openings 32 formed in both side skins 16.

In addition, the overlying fiberglass layer 18 and fabric layer 19 also have similar vertically-elongate rectangular openings formed therein in alignment with the skin opening 32, although the opening as formed or cut into the fabric layer 19 is slightly undersized relative to the skin opening 32 so as to leave sufficient fabric edges for securement to the port retention arrangement, as explained hereinafter.

After the openings have been appropriately formed in the fabric 19, fiberglass 18 and skin 16, then the portion of the honeycomb 17 behind the skin opening 32 is also removed. Portions of the honeycomb directly adjacent the edge of the opening are preferably slightly compressed to provide sufficient clearance for the structure of the port retention arrangement, as will be apparent from the following description.

After the openings have been suitably formed, which forming of the openings can take place while the panel is in the field so as to permit retrofitting of this port retention arrangement thereon, then the components associated with the port retention arrangement are suitably assembled.

Figure 6:
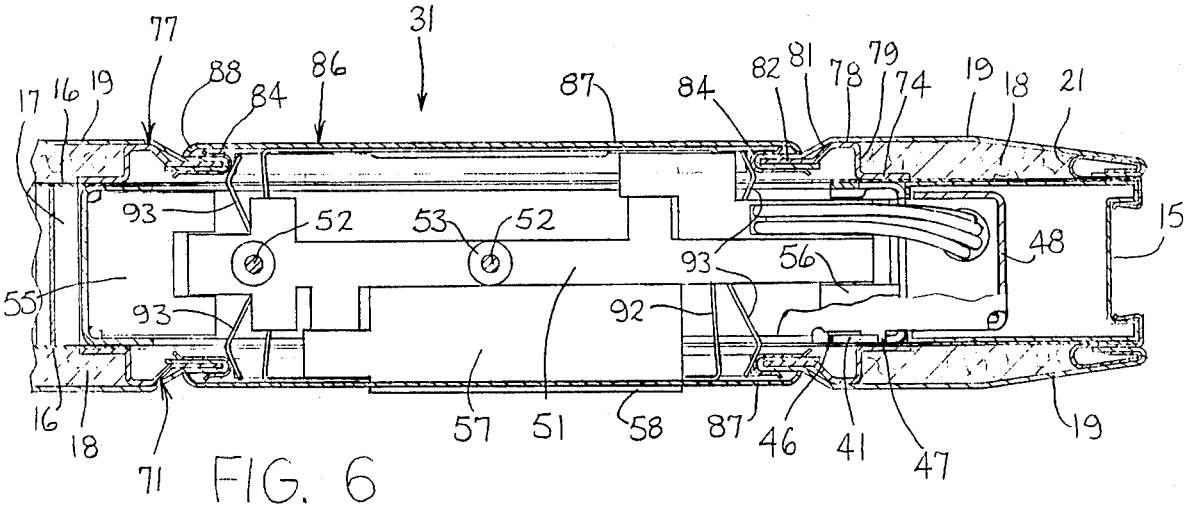
FIGS. 5 and 6 are fragmentary sectional views taken substantially along lines V—V and VI—VI, respectively, in FIG. 4.
Figure 2:
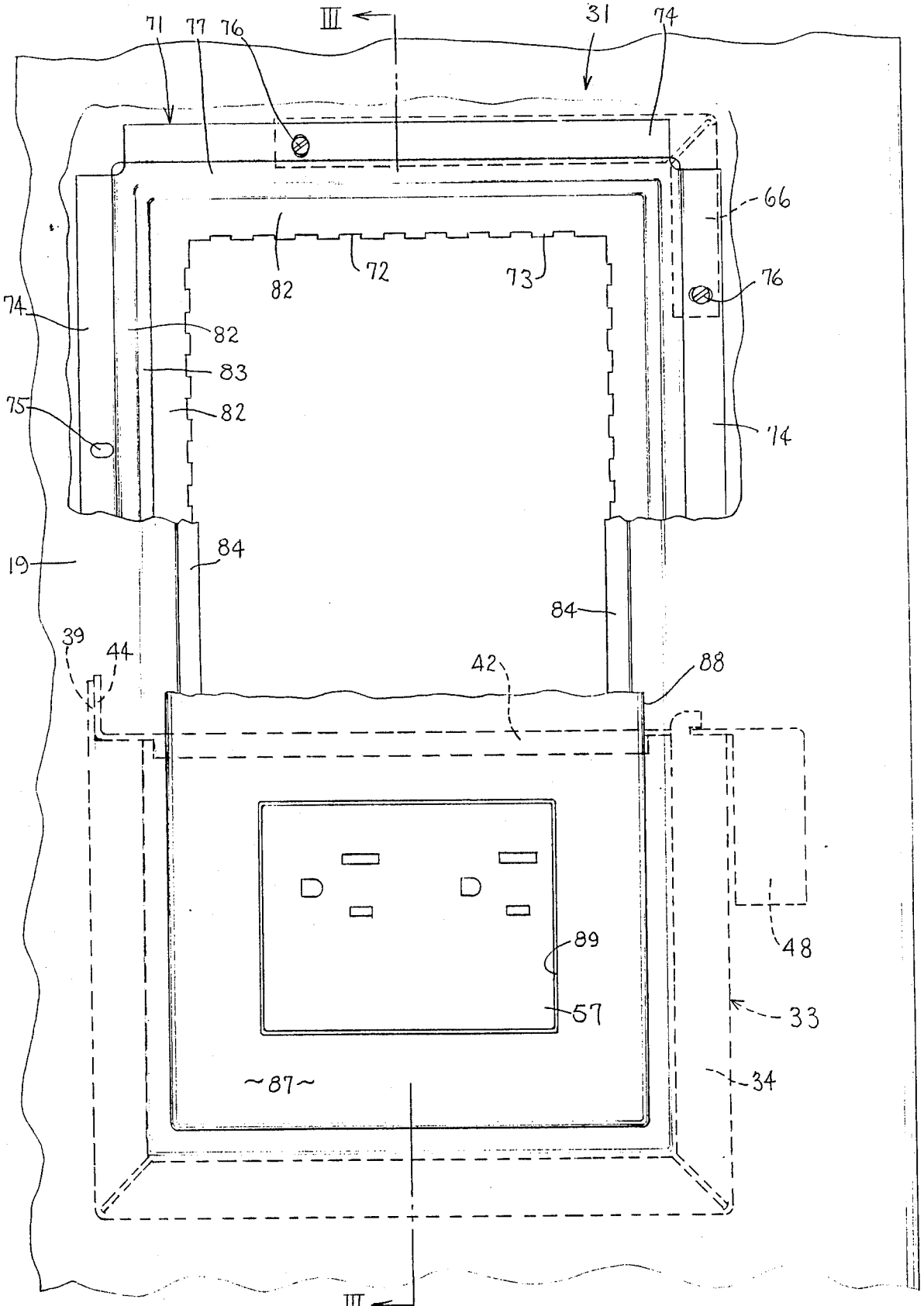
FIG. 2 is a fragmentary, enlarged side view of that part of the panel having the port retention arrangement associated therewith.
Figure 4:
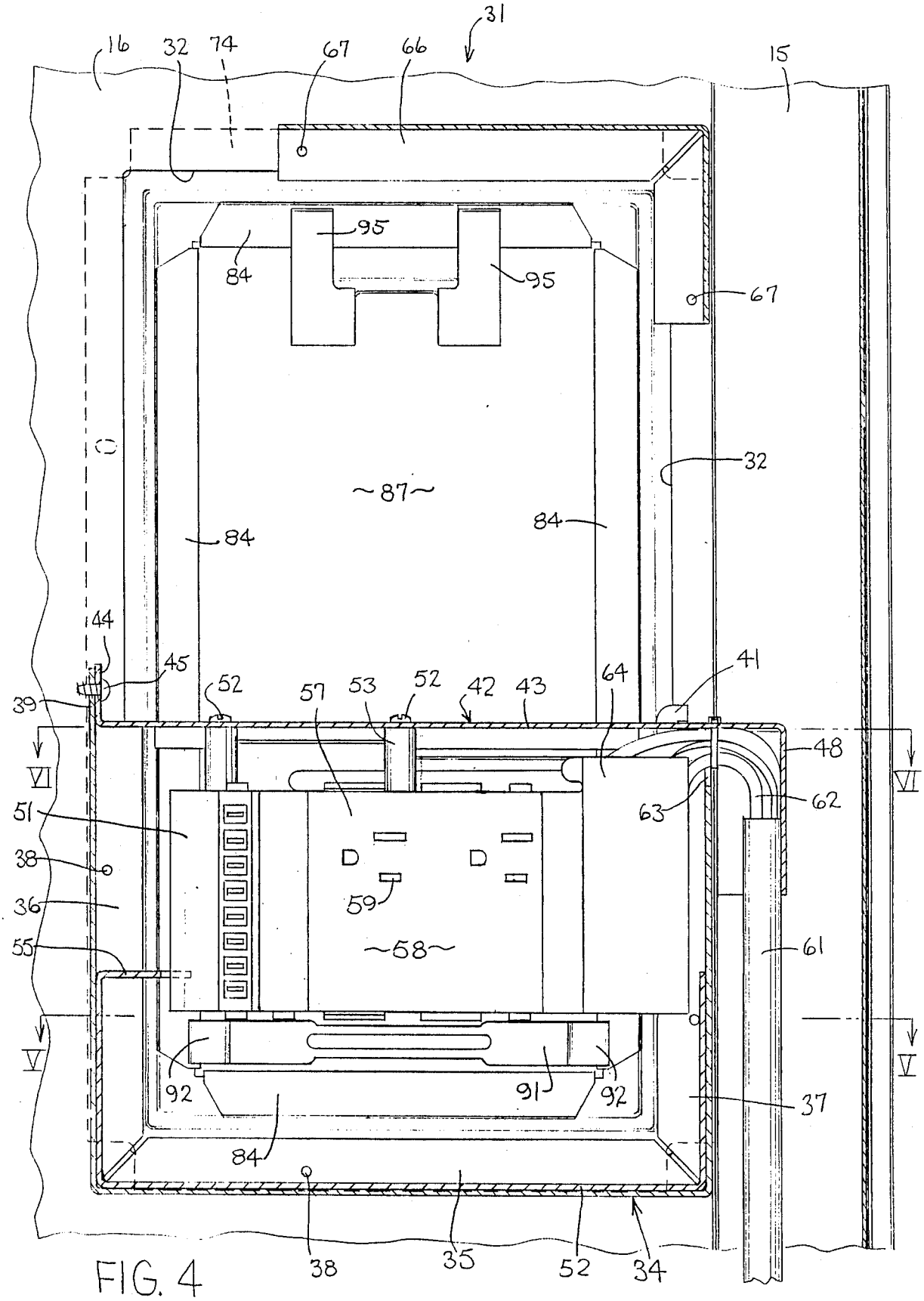
FIG. 4 is a view similar to FIG. 2 but taken substantially along line IV—IV in FIG. 3.
Figure 5:
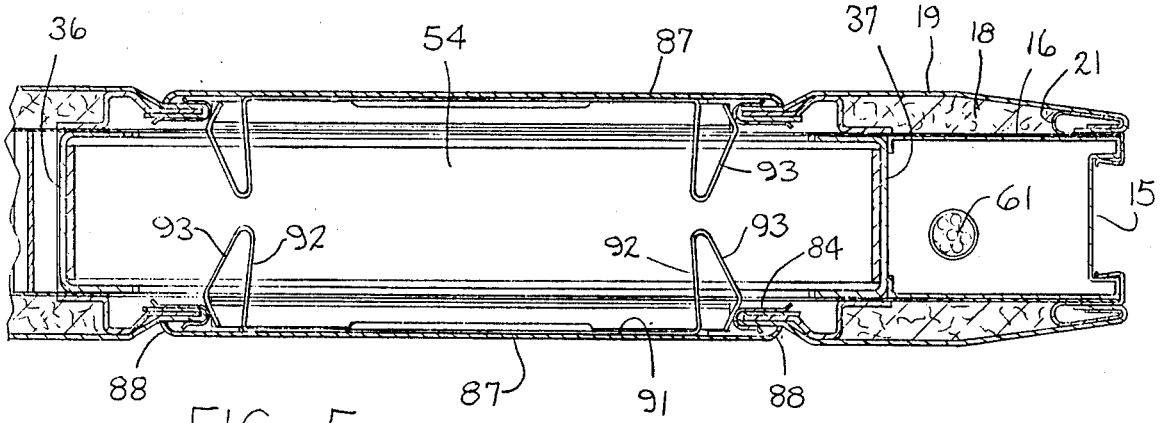

The port retention arrangement 31 includes an inner two-piece power block frame 33 which is of a substantially rectangular ring-shaped configuration. This inner frame 33 includes a generally one-piece lower frame part 34 which is of a generally upwardly-opening U-shaped configuration and includes a generally horizontal bottom leg 35 joined at opposite ends to vertically upwardly projecting side legs 36 and 37. These side legs 36 and 37 are horizontally spaced apart by an amount which approximately corresponds to the width of the skin opening 32. However, these side legs 36 and 37 project upwardly through a vertical extent which is only a fraction, such as about one half, the height of the skin opening 32. These legs 35, 36, 37 which define the lower frame part 34 are all of a generally channel-shaped cross section having generally parallel side legs having outer surfaces which are spaced apart by a dimension which substantially equals the perpendicular spacing between the side skins 16. This lower frame part 34 can hence be inserted through one of the skin openings 32 and thence positioned between the side skins 16 so that the base leg 35 is disposed directly below the lower edge of the skin opening, whereas the side legs 36 and 37 project upwardly along opposite sides of the skin opening. When the lower frame part 34 is positioned between the skins 16, it is preferably disposed so that the vertical side leg 37 is disposed directly adjacent and substantially abuts against inner vertically extending flanges associated with the side frame rail 15, such as illustrated by FIGS. 4–6. The side flanges of the lower frame part 34 have suitable openings 38 therethrough at spaced locations for receiving fasteners, as explained below.

The one side leg 36 has, adjacent the upper end thereof, a substantially planar tab part 39 which projects upwardly a small vertical extent beyond the side flanges of the respective vertical leg 36. The other vertical side leg 37, at the upper end thereof and at an elevation corresponding with the tab part 39, is provided with a pair of sidewardly spaced hook parts 41 projecting upwardly from the side flanges of the leg 37. These hook parts 41 open sidewardly toward the adjacent side frame rail 15.

The inner frame 33 also includes a top frame part 42 which is removably fixed to and extends across the open top of the lower frame part 34 to hence effectively define a rigid rectangular ring. This top frame part 42 is of a generally channel-shaped cross section and extends horizontally between and is supported on the upper ends of the vertical legs 36 and 37. The top frame part 42 includes a base wall or bight 43 which, at its leftward end in FIG. 4, is supportingly engaged on the upper end of the side leg 36, and which is formed to have an upwardly-turned tab part 44 which directly overlies the tab part 39. These latter tab parts have aligned openings, and a suitable fastener such as a screw 45 extends therethrough for rigidly joining the upper and lower frame parts together.

The other end of the top frame part 42 has shallow recesses 46 formed inwardly from opposite sides thereof, which recesses accommodate therein the hook parts 41. Tabs 47 project outwardly from opposite sides of the top frame part 42 directly outwardly from the recesses 46 and project into the sidewardly-directed mouths defined by the hook parts 41 to hence secure this end of the top frame part 42 to the side leg 37.

The rightward end of the bight 43, as illustrated in FIG. 4, also projects outwardly a limited extent into the interior of the side frame rail 15, and has a U-shaped shield or shroud fixed thereto and projecting downwardly therefrom a limited extent. This shroud 48 is hence positioned within the side frame rail 15.

The inner frame 33 is provided for permitting mounting of an electrical receptacle unit substantially at work-surface height and accessible through the side surface of the panel. Hence, an electrical power block 51 is secured within the inner frame 33 and, in the illustrated embodiment, is fixedly secured to and carried directly from the top frame part 42. A pair of mounting screws 52 extend through the top frame part 42 and into suitable mounting spacers or elements 53 which are rigidly joined to the housing of the power block 51.

The positioning and rigidity of the power block as mounted on the inner frame is further facilitated by a generally U-shaped upwardly-opening retainer 54 which is slidable telescopically received into the lower end of the lower frame part 34. This U-shaped retainer 54 is vertically slidably accommodated within the lower frame part 34 so as to be supported on the lower leg 35 thereof. The retainer 54 has, adjacent the upper free end of one of the vertical legs thereof, a generally inwardly directed retaining flange 55 which is generally U-shaped to hence define a notch which accommodates one edge of the power block substantially as illustrated by FIG. 6. A similar inwardly directed flange 56 is associated with the upper end of the other side leg of the retainer 54 to hence provide a sideward confinement of the power block relative to the inner frame 33. The retaining flange 56 in this case is disposed adjacent only one side of the power block, which power block itself has other structure which substantially abuts the other side of the frame. However, it will be appreciated that the flange 56 could also be U-shaped similar to the flange 55 if necessary or desired. These retaining flanges 55 and 56 hence engage the power block adjacent the lower extremity thereof to provide rigidity in a direction which is generally perpendicular with respect to the side of the panel and which, coupled with the securing screws 52, hence provide a strong and rigid positioning of the power block.

The power block 51 is adapted to have an electrical receptacle unit 57 detachably but electrically joined thereto, the latter having a front face 58 which is adapted to be disposed approximately flush with the side surface of the panel. This front face 58 has at least one conventional three-hole electrical socket 59 (i.e. an electrical port) associated therewith for accommodating a conventional two-prong or three-prong electrical plugs.

To supply electrical power to the power block 51 and its associated receptacle unit 57, an electrical conduit 61 is extended vertically along the side frame rail 15, such as upwardly from the base channel 24 (or downwardly from the top frame rail if the electrical extends along the top of the panel). This conduit 61 projects upwardly into the shroud 48, at which points its individual cables or wires 62 project outwardly and then are bent inwardly so as to pass through an opening 63 formed in the bight or base wall of the vertical leg 37. These wires 62 are joined to an electrical connection block 64 which joins to the power block 51, such as by being plugged into the power block.

While the invention has been illustrated as having a receptacle unit 57 associated with only one side of the power block so as to project outwardly through one side of the panel, as illustrated in the lowermost side in FIG. 6, it will be appreciated that the power block can also be designed to accommodate a removable receptacle on the other side if desired so that both sides of the panel will have accessibility to electrical power. The structure of the power block, the receptacle unit, and the manner in which electrical power is supplied thereto, is already well known in the office furniture industry. One example of such structure is illustrated by the assignee's U.S. Pat. No. 4 781 609.

In addition to the positioning of the inner frame 33 between the skins 16 adjacent the lower half of the skin opening 32, there is also preferably provided an additional spacer or frame element 66 which is positioned between the side skins 16 in the vicinity of the upper edge of the skin opening 32. This spacer 66, in the illustrated embodiment, is of a generally L-shaped configuration, and has a generally channel-shaped cross section, so that it can be snugly accommodated between the skins 16 and extend at least partially along the upper edge of the skin opening and around one corner so as to extend partially along one of the vertical edges of the skin opening. The vertical leg of this spacer 66 is preferably disposed so as to substantially abut the inner flanges of the side frame rail 15 to facilitate proper positioning of the spacer 66. This spacer 66 also preferably has openings 67 through the side flanges thereof for receiving fasteners, as explained below.

The port retention arrangement also includes an outer frame 71 which is adapted to be positioned so as to directly overlie the outer surface of the skin 16 in surrounding relationship to the opening 32. This outer frame 71 is of a one-piece structure and has a rectangular ring-shaped configuration so as to surround the skin opening 32. The frame 71 defines therein a generally rectangular opening 72 which is aligned with the skin opening 32, with the inner edge of this frame 71 being provided with fabric gripping teeth 73 extending therealong, which teeth are preferably of a square corner profile.

The rectangular ring-shaped outer frame 71 includes generally parallel upper and lower frame elements which are rigidly joined together by a pair of parallel vertical frame elements, with all of these frame elements having a generally identical cross section.

More specifically, the cross section of the frame elements defining the outer frame 71 include a generally outer base leg 74 which is adapted to directly overlie the outer surface of the skin 16. This base leg, throughout the outer frame, has several fastener-accommodating openings 75 therethrough. These openings 75 are intended to align with the openings 38 and 67 associated with the inner frame and the spacer frame, and by forming corresponding openings through the skin 16, suitable fasteners such as screws 76 are then extended through the openings to hence fixedly join the outer frame 71 to the inner frame 33 and the spacer frame 66, with the skin 16 being rigidly sandwiched therebetween.

The cross sectional profile of the frame elements defining the outer frame 71, directly inwardly of the outer base leg 74, has a channel-like profile 77 which projects outwardly from the plane of the base leg 74. This channel-like profile 77 includes a base wall 78 which is spaced outwardly a predetermined distance from the base leg 74 and is joined thereto by a transverse wall 79 which extends generally perpendicularly therebetween. The leg 74 and the walls 78 and 79 hence define a generally Z-shaped configuration. The outer surface of this base wall 78 is intended to be substantially flush with the outer surface of the fiberglass layer 18 to hence permit the side fabric 19 to extend directly thereacross.

The channel profile 77 also includes a further transverse wall 81 which projects inwardly from the inner edge of the base wall 78. This transverse wall 81 is inclined at an angle, such as about 45°, from the plane of the base wall 78 as it projects inwardly to hence provide a smoother exterior contour. The inner edge of this transverse wall 81 in turn joins to a generally planar inner leg 82, the latter having a free edge which defines the toothed edge of the opening 72. This inner leg 82 is disposed in a plane which is generally parallel to that of the outer leg 74, but is disposed approximately midway between the planes of the outer leg 74 and the base wall 78.

As illustrated by FIG. 6, the fiberglass layer 18 which overlies the skin 16 is also positioned so as to substantially overlie the outer leg 74, with the free edge of the fiberglass layer, as defined around the substantially rectangular opening formed therein, being disposed substantially adjacent the transverse leg 79. However, the fabric 19 is adapted to extend beyond the fiberglass layer and across the base wall 78 of the channel-like profile, with the free edge portion of the fabric (that is, the edge defined around the opening formed therein) being wrapped around the toothed edge 73 of the opening formed in the outer frame 71. After the edge portion of the fabric has been suitably wrapped around the toothed edge, then an elongate channel-like fabric retainer clip 84 is slidably inserted over the inner leg 82, and over the fabric wrapped therearound, to hence resiliently retain the fabric in a position wherein it is engaged with the toothed edge 73 of the outer frame 71. This fabric retainer 84 preferably extends throughout substantially the complete length of each inner edge of the rectangular outer frame 71, and the retainer 84 preferably requires a slight elastic opening of the legs so as to enable it to be snugly and securely inserted over the fabric as wrapped around the leg 82.

Thereafter a removable cover assembly 86 is snappingly secured to the panel to hence provide a finished exterior appearance. This cover assembly 86 includes a main one-piece cover 87, such as of a plastics material. This main over 87 is primarily of a generally planar sheet-like configuration but is preferably provided with inturned or rounded edges 88 extending therearound. This cover 87 has a generally rectangular configuration which is slightly greater than the opening 72 so that the rounded edges 88 of the cover, when mounted on the panel, effectively overlap and engage the fabric which directly overlies the inner legs 82, thereby resulting in the front surface of the cover 87 being substantially coplanar with the side surface of the panel as defined by the fabric 19.

Figure 3:
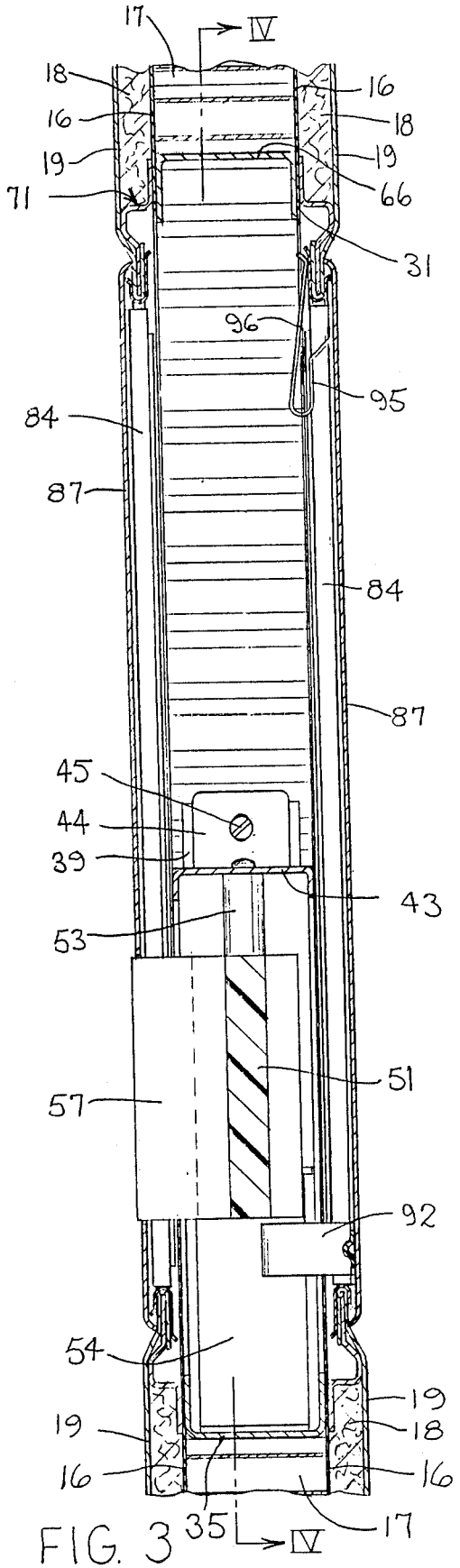
FIG. 3 is a sectional view as taken substantially along line III—III in FIG. 2.

To resiliently but removably secure the cover assembly 86 to the panel, the cover 87 has a pair of generally U-shaped retainer clips 95 secured to the rear surface thereof in the vicinity of the upper edge. These clips have rear cantilevered resilient legs 96 which project upwardly and, as illustrated by FIG. 3, are intended to project behind the inner leg 82 of the upper frame element to hence resiliently secure the upper edge of the cover assembly to the panel.

The cover assembly also has releasable spring clips associated with the lower edge thereof. For this purpose, a strip 91 is secured, as by bonding, to the rear surface of the cover 87 adjacent the lower edge thereof. This strip at opposite ends defines inwardly-projecting U-shaped resilient clips 92. These clips 92 have cantilevered free legs 93 which are resiliently deflectable and define inner and outer cam surfaces which are oppositely sloped. These resilient caming legs 93 hence engage the opposed vertically-extending fabric retainers 84 when the cover is being inserted so that the spring clips 92 resiliently deflect inwardly until the cover is fully inserted, at which point they resiliently snap outwardly to hence lock the lower edge of the cover in position, substantially as illustrated by FIG. 6. However, by forcibly moving the lower edge of the cover outwardly, these clips can be releasably disengaged to hence permit removal of the cover assembly when desired.

The cover 87 has a suitable opening 89 therethrough for closely accommodating the profile of the receptacle unit 57.

The upper half of the opening formed in the panel, namely that portion of the opening located above the upper frame part 42, is generally open so as to accommodate suitable communication ports or connectors such as for a telephone, a computer or the like. If such communication connectors are provided, then communication cables can extend vertically down the side rail 15 into the open region, whereupon the connectors can then be mounted using conventional hardware. The connectors will then extend outwardly through the side of the panel through suitable openings formed in the upper portion of the cover 87.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In an upright space-dividing wall panel having a generally rectangular ring-shaped interior framework, a pair of thin sheet-like side skins secured to opposite sides of said ring-shaped framework and extending across the interior thereof, a layer of a flexible sound-absorbing material coextensively overlying the exterior surface of a first said side skin, and a thin layer of flexible fabric directly and exteriorly overlying said layer of sound-absorbing material for defining an exterior side surface of the panel, the improvement comprising:

said first skin having a generally rectangular opening formed therethrough for communication with a core region defined between said skins within said ring-shaped framework, said rectangular opening being spaced at least a small horizontal distance inwardly from one vertical edge of the panel, and being spaced downwardly a substantial distance from the upper edge of the panel and upwardly a substantial distance from the lower edge of the panel, whereby said rectangular opening is disposed approximately at worksurface height;

said sound absorbing layer and said fabric layer also having generally rectangular openings therethrough substantially in alignment with and approximately corresponding to the opening through said first skin, the opening through said fabric layer being spaced inwardly from the vertical free edge of the fabric layer;

an inner frame positioned between said skins in at least partial surrounding relationship to the opening formed in said first skin, said inner frame being removably positioned between said skins;

an electrical power unit stationarily mounted on said inner frame and positioned substantially within the core region in alignment with the opening in said first skin, said electrical power unit having means which project outwardly of said opening and define a conventional electrical socket which is disposed approximately flush with the side surface of the panel;

an outer ring-shaped frame of generally rectangular configuration positioned so as to directly overlie the outer surface of said first skin in surrounding relationship to the opening therethrough, said outer frame and said inner frame being fixedly fastened together so that said first skin, in the vicinity of the opening therethrough, is fixedly sandwiched therebetween;

said ring-shaped outer frame having an inner generally rectangular-shaped edge defining a frame opening which is aligned with and approximately corresponds in size to the opening through said first skin, said fabric layer having edge parts in the vicinity of the rectangular opening therethrough which are wrapped around the inner edge of said outer frame;

elongated resilient channel-shaped fabric retainers positioned over the inner edge of said outer frame for clamping the edge parts of the fabric layer therearound; and a cover assembly removably attached to said panel for closing off said openings, said cover assembly including a generally one-piece cover of generally planar configuration disposed approximately coplanar with the side surface of the panel, said cover assembly having inwardly projecting clips which create a snap-type releasable engagement with the outer frame, said cover having an opening therethrough for accommodating the electrical socket.

2. A panel according to claim 1, wherein the outer frame is defined by horizontally and vertically elongate frame elements which are rigidly joined together to define a ring-shaped configuration, each frame element having a cross sectional configuration which includes an outer flat leg which directly overlies the outer surface of the first skin in surrounding relationship to the opening therethrough and which is joined at its inner edge to a channel-like profile which projects outwardly away from the first skin and defines a generally flat surface which is substantially coplanar with the exterior side surface of the panel as defined by the fabric layer, said channel-like profile at its inner edge being joined to an inner leg which is disposed in a plane which is located outwardly from the first skin but inwardly from the plane of the fabric layer, said inner leg defining thereon an inner edge which defines the opening through the outer frame, said inner edge being toothed for gripping the fabric edge part which is wrapped therearound.

3. A panel according to claim 2, wherein said inner frame is of a generally rectangular ring-shaped configuration and includes a generally upwardly-opening U-shaped lower frame part which is disposed between the side skins and extends along the lower edge of the opening and partially upwardly along the opposite side edges of the opening, said inner frame including an upper frame part which extends between and fixedly but releasably attaches to vertical legs of the lower frame part adjacent upper ends thereof, said electrical power unit being fixedly mounted on and suspended downwardly from said upper frame part, said upper frame part being disposed approximately midway between upper and lower extremities of the rectangular opening formed in said first skin.

4. A panel according to claim 3, including a separate spacer frame positioned between said skins directly adjacent the upper edge of said opening, said spacer frame and said outer frame being rigidly joined together by fasteners so that the first skin is fixedly sandwiched therebetween.

5. A panel according to claim 3, wherein said upper frame part at one end thereof projects outwardly into the interior of an adjacent side rail of said framework and has a channel-like shroud which projects vertically a limited extent along the interior of said side frame rail for accommodating therein an electrical cable which projects vertically of the side frame rail for supplying electrical power to the electrical power unit, said electrical cable extending vertically of the shroud and then being bent inwardly into the inner frame.

6. A panel according to claim 2, wherein said channel-like profile projects outwardly from said outer leg by an amount which approximately corresponds to the thickness of the layer of sound absorbing material so that said latter layer extends to a point substantially adjacent said channel-like profile.

* * * * *